US010455892B2

(12) United States Patent
Iuchi et al.

(10) Patent No.: US 10,455,892 B2
(45) Date of Patent: Oct. 29, 2019

(54) SOLE STRUCTURE FOR SHOES AND SHOE WITH THE SOLE STRUCTURE

(71) Applicant: MIZUNO CORPORATION, Osaka (JP)

(72) Inventors: Kazunori Iuchi, Osaka (JP); Yusuke Ide, Osaka (JP); Natsuki Sato, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 0 days.

(21) Appl. No.: 15/720,300

(22) Filed: Sep. 29, 2017

(65) Prior Publication Data

US 2018/0092431 A1 Apr. 5, 2018

(30) Foreign Application Priority Data

Sep. 30, 2016 (JP) ..... 2016-193397

(51) Int. Cl.

| | |
|---|---|
| ***A43B 13/12*** | (2006.01) |
| ***A43B 13/18*** | (2006.01) |
| ***A43B 13/22*** | (2006.01) |
| ***A43B 13/02*** | (2006.01) |
| ***A43B 13/14*** | (2006.01) |

(52) U.S. Cl.

CPC ..... *A43B 13/12* (2013.01); *A43B 13/026* (2013.01); *A43B 13/125* (2013.01); *A43B 13/14* (2013.01); *A43B 13/181* (2013.01); *A43B 13/185* (2013.01); *A43B 13/186* (2013.01); *A43B 13/22* (2013.01); *A43B 13/143* (2013.01)

(58) Field of Classification Search

CPC ..... A43B 13/14; A43B 13/181; A43B 13/185; A43B 13/186

USPC ..... 36/28, 30 R

See application file for complete search history.

(56) References Cited

U.S. PATENT DOCUMENTS

| | | | | |
|---|---|---|---|---|
| 2,090,881 A * | 8/1937 | Wilson | A43B 13/20 | 36/29 |
| 5,440,826 A * | 8/1995 | Whatley | A43B 13/181 | 36/25 R |
| 6,915,594 B2 * | 7/2005 | Kim | A43B 7/08 | 36/29 |

(Continued)

FOREIGN PATENT DOCUMENTS

| | | |
|---|---|---|
| JP | 2000-333707 A | 12/2000 |
| JP | 2007-508055 A | 4/2007 |

*Primary Examiner* — Ted Kavanaugh

(74) *Attorney, Agent, or Firm* — Troutman Sanders LLP; Daniel Sharpe

(57) ABSTRACT

Disclosed is a sole structure for shoes, which includes a lower midsole. The lower midsole includes a medial-side midsole portion which extends in a medial side portion of a heel region supporting a heel of a wearer's foot, and a lateral-side midsole portion which extends in a lateral side portion of the heel region, and which faces, and is spaced apart from, the medial-side midsole portion in a foot width direction. The lateral-side midsole portion includes supports which are arranged adjacent to each other in a longitudinal direction with a gap interposed therebetween and which support the wearer's heel, and a coupling portion which is provided in the gap, and couples the adjacent supports to each other to reduce displacement or twist in the foot width direction occurring between the adjacent supports.

12 Claims, 10 Drawing Sheets

(56) References Cited

U.S. PATENT DOCUMENTS

| | | | | |
|---|---|---|---|---|
| 2008/0052965 | A1* | 3/2008 | Sato | A43B 13/026 36/103 |
| 2011/0239489 | A1* | 10/2011 | Iuchi | A43B 13/12 36/30 R |
| 2012/0233885 | A1* | 9/2012 | Shaffer | A43B 13/20 36/103 |
| 2013/0212909 | A1* | 8/2013 | Bates | A43B 13/189 36/102 |
| 2015/0107132 | A1* | 4/2015 | Takeshita | A43B 13/18 36/28 |

* cited by examiner

SOLE STRUCTURE FOR SHOES AND SHOE WITH THE SOLE STRUCTURE

CROSS-REFERENCE TO RELATED APPLICATIONS

This application claims priority to Japanese Patent Application No. 2016-193397 filed on Sep. 30, 2016, the entire disclosure of which is hereby incorporated by reference.

BACKGROUND

The present disclosure relates to a sole structure for shoes and a shoe including such a sole structure.

A sole structure has been generally widely known, which includes, as major components, a midsole made of a soft elastic material and an outsole bonded to the lower surface of the midsole. As such a sole structure, for example, Japanese Unexamined Patent Publication No. 2000-333707 proposes a sole structure for athletic shoes. As a sole structure which exhibits enhanced flexibility when touching the ground, for example, Japanese Unexamined Patent Publication No. 2007-508055 proposes a sole structure for athletic shoes.

The sole structure disclosed in Japanese Unexamined Patent Publication No. 2000-333707 includes an outsole having a ground surface on its lower surface, and a midsole made of an elastic material and overlaid above the outsole. The midsole includes a medial-side midsole portion which is arranged at a position corresponding to a medial side of a hindfoot of a foot and extends in a longitudinal direction, and a lateral-side midsole portion which is arranged at a position corresponding to a lateral side of the hindfoot and extends in the longitudinal direction. The lateral-side midsole portion faces, and is spaced apart from, the medial-side midsole portion in a foot width direction.

The sole structure disclosed in Japanese Unexamined Patent Publication No. 2007-508055 has a plurality of grooves (i.e., sipes) recessed upward with respect to the ground surface of the outsole and linearly extending in a foot width direction. These grooves for flexibility are arranged over an area corresponding to an area from the forefoot to the hindfoot of a foot and spaced apart from one another in the longitudinal direction.

SUMMARY

In general, when a shoe touches the ground while the wearer is walking or running, a so-called load path occurs, which represents the shift of the wearer's body weight. The load path starts from a lateral side portion of a heel region in a hindfoot, passes through a central region of a hindfoot in the foot width direction, a central portion of a midfoot, and a medial side portion of a forefoot, and reaches the tiptoes. In this load path, an initial impact which occurs when the wearer's shoe touches the ground is mainly applied to the heel region.

However, in the sole structure of Japanese Unexamined Patent Publication No. 2000-333707, the medial-side and lateral-side midsole portions both extend long in the longitudinal direction, and therefore, do not bend pliantly in the longitudinal direction when the heel portion of the wearer's shoe touches the ground. In other words, the medial-side and lateral-side midsole portions are not configured to allow the heel portion of the wearer's shoe to gradually touch the ground such that the wearer could feel his/her heel softly touch the ground. Therefore, the sole structure of Japanese Unexamined Patent Publication No. 2000-333707 is not capable of reducing the angular velocity (so called plantar flexion angular velocity) of the wearer's foot joints to a moderate level, or keeping the heel portion stably in contact with the ground for a sufficient period of time. As a result, this sole structure is incapable of cushioning the initial impact described above with the medial-side and lateral-side midsole portions.

It is conceivable to divide each of the medial-side and lateral-side midsole portions of Japanese Unexamined Patent Publication No. 2000-333707 into several parts adjacent in the longitudinal direction by forming the plurality of grooves described in Japanese Unexamined Patent Publication No. 2007-508055. However, while this configuration increases the flexibility of the hindfoot portion of the sole structure, the sole structure may become unstable because, when receiving the initial impact, the divided pars of the medial-side and lateral-side midsole portions may excessively lean toward the medial side or lateral side.

In view of the foregoing background, one or more aspects of the present disclosure are directed to a sole structure for shoes which is capable of cushioning an initial impact occurring when a wearer's shoe touches the ground so as to allow the wearer to feel his/her heel softly touch the ground, and which allows the wearer to step on the ground stably.

A first aspect of the present disclosure relates to a sole structure for shoes. The sole structure includes an outsole having a ground surface on a lower surface of the outsole, and a midsole made from an elastic material and overlaid above the outsole. The midsole includes a medial-side midsole portion which extends in a longitudinal direction in a medial side portion of a heel region supporting a heel of a wearer's foot, and a lateral-side midsole portion which extends in the longitudinal direction in a lateral side portion of the heel region, and which faces, and is spaced apart from, the medial-side midsole portion in a foot width direction. At least one of the medial-side midsole portion or the lateral-side midsole portion includes a plurality of supports which are arranged adjacent to each other in the longitudinal direction with a gap interposed between adjacent ones of the plurality of supports, and which support the heel of the wearer's foot, and a coupling portion which is provided in the gap, and couples the adjacent ones of the plurality of supports to each other to reduce displacement or twist in the foot width direction occurring between the adjacent ones of the plurality of supports.

According to the first aspect, the at least one of the medial-side midsole portion or the lateral-side midsole portion includes the plurality of supports supporting the heel of the wearer's foot and arranged adjacent to each other in the longitudinal direction with the gap interposed therebetween. When the sole structure touches the ground, the gap allows the adjacent supports to rock toward and away from each other each other (i.e. in the longitudinal direction). Consequently, when the wearer's shoe touches the ground, the midsole portion having the plurality of supports is easily bent in the longitudinal direction. This bending of the midsole portion causes the hindmost support to touch the ground first, and then, causes the other supports located forward of the hindmost support to touch the ground sequentially. As can be seen, at least one of the medial-side midsole portion or the lateral-side midsole portion is pliantly bent in the longitudinal direction, thereby reducing the angular velocity (so-called plantar flexion angular velocity) of the wearer's foot joints to a moderate level, and keeping the heel region stably in contact with the ground for a sufficient period of time. As a result, according to the first aspect, the initial impact applied to the wearer's foot may be cushioned sufficiently. The coupling portion, which is provided in the gap and configured to reduce displacement or twist in the foot width direction occurring between the supports, maintains the supports stabilized such that the supports are substantially prevented from excessively leaning toward the medial side or the lateral side even if the initial impact described above is applied to the supports. That is to say, according to the first aspect, while the coupling portion substantially prevents the supports from swinging in the foot width direction, the wearer is allowed to step the ground stably. Thus, the sole structure according to the first aspect cushions the initial impact applied when the wearer's shoe touches the ground, allows the wearer to foot his/her foot softly touch the ground. The sole structure is further capable of substantially preventing the heel region from swinging in the foot width direction, and allows the wearer to step the ground stably.

A second aspect of the present disclosure is an embodiment of the first aspect. According to the second aspect, the coupling portion has a shape of which a length in the foot width direction is greater than a thickness in the vertical direction.

Specifically, according to the second aspect, making the thickness in the vertical direction of the coupling portion relatively thin may reduce the flexural rigidity in the longitudinal direction of the coupling portion, while making the length in the foot width direction of the coupling portion relatively long may increase the flexural rigidity in the foot width direction of the coupling portion. Consequently, according to the second aspect, the midsole portion is easily bent in the longitudinal direction at the coupling portion, and the supports may be substantially prevented from excessively leaning toward the medial side or the lateral side even if the initial impact described above is applied to the supports.

A third aspect of the present disclosure is an embodiment of the first aspect. According to the third aspect, the coupling portion is arranged at a substantially meddle in the vertical direction in the gap, in a side view, and a clearance is provided above the coupling portion to keep the plurality of supports from interfering with each other.

According to the third aspect, the coupling portion is arranged, in a side view, at a substantially middle in the vertical direction in the gap. This facilitates the supports to rock relative to each other in the longitudinal direction from the coupling portion. The clearance provided above the coupling portion substantially prevents the supports from interfering with each other. Therefore, when the midsole portion is bent upward, the supports are not allowed to interfere with each other in the clearance provided above the coupling portion. Thus, according to the third aspect, the midsole portion may have further increased flexibility.

A fourth aspect of the present disclosure is an embodiment of the third aspect. According to the fourth aspect, a groove which is recessed downward and extends in the foot width direction is formed in an upper portion of the coupling portion.

According to the fourth aspect, the supports easily rock relative to each other in the longitudinal direction from the recess of the coupling portion, and thus, the midsole portion may have further increased flexibility.

A fifth aspect of the present disclosure is an embodiment of the first aspect. According to the fifth aspect, the lateral-side midsole portion includes the plurality of supports and the coupling portion.

According to the fifth aspect, the lateral-side midsole portion includes the plurality of supports supporting a lateral side portion of the heel of the wearer's foot and arranged adjacent to each other in the longitudinal direction with the gap interposed therebetween. Therefore, the lateral-side midsole portion is easily bent in the longitudinal direction when the lateral side portion of the heel region touches the ground along the load path described above. Thus, bending of the lateral-side midsole portion cushions the initial impact applied when the wearer's shoe touches the ground, and allows the wearer to feel his/her foot softly touch the ground. While the coupling portion substantially prevents the supports of the lateral-side midsole portion from swinging in the foot width direction, the wearer is allowed to step on the ground stably. Thus, the sole structure is capable of substantially preventing the lateral side portion of the heel region from swinging in the foot width direction, and allows the wearer to step the ground stably. The fifth aspect may guide the wearer's body weight along the optimal load path of the wearer's foot when the wearer is walking or running.

A sixth aspect of the present disclosure is an embodiment of the first aspect. According to the sixth aspect, the medial-side midsole portion includes the plurality of supports and the coupling portion, and the lateral-side midsole portion includes the plurality of supports and no coupling portions.

According to the sixth aspect, the medial-side midsole portion includes the plurality of supports and the coupling portion, while the lateral-side midsole portion includes the plurality of supports and no coupling portions. Thus, both the medial-side midsole portion and the lateral-side midsole portion cushion the initial impact applied when the wearer's shoe touches the ground, and allow the wearer to feel his/her foot softly touch the ground. According to the sixth aspect, while the medial side portion of the heel region is substantially prevented from swinging in the foot width direction, the wearer is allowed to step the ground stably.

A seventh aspect of the present disclosure is an embodiment of the first aspect. According to the seventh aspect, the lateral-side and medial-side midsole portions each include the plurality of supports and the coupling portion.

According to the seventh aspect, both the medial-side midsole portion and the lateral-side midsole portion cushion the initial impact applied when the wearer's shoe touches the ground, and allow the wearer to feel his/her foot softly touch the ground. Further, while the medial side portion and the lateral side portion of the heel region are substantially prevented from swinging in the foot width direction, the wearer is allowed to step the ground stably.

Eighth to fourteenth aspects of the present disclosure are directed to shoes comprising the sole structure of the first to seventh aspects, respectively.

According to the eighth to fourteenth aspects, shoes may be provided which are as advantageous as the first to seventh aspects.

As can be seen from the foregoing, the present disclosure cushions the initial impact applied when the wearer's shoe touches the ground, and allows the wearer to feel his/her foot softly touch the ground. Further, the present disclosure allows the wearer to step the ground stably, while the heel region is substantially prevented from swinging in the foot width direction.

DETAILED DESCRIPTION

Embodiments of the present disclosure will now be described with reference to the drawings. Note that the following description of the embodiments is a merely beneficial example in nature, and is not intended to limit the scope, application, or uses of the present disclosure.

First Embodiment

Figure 1:
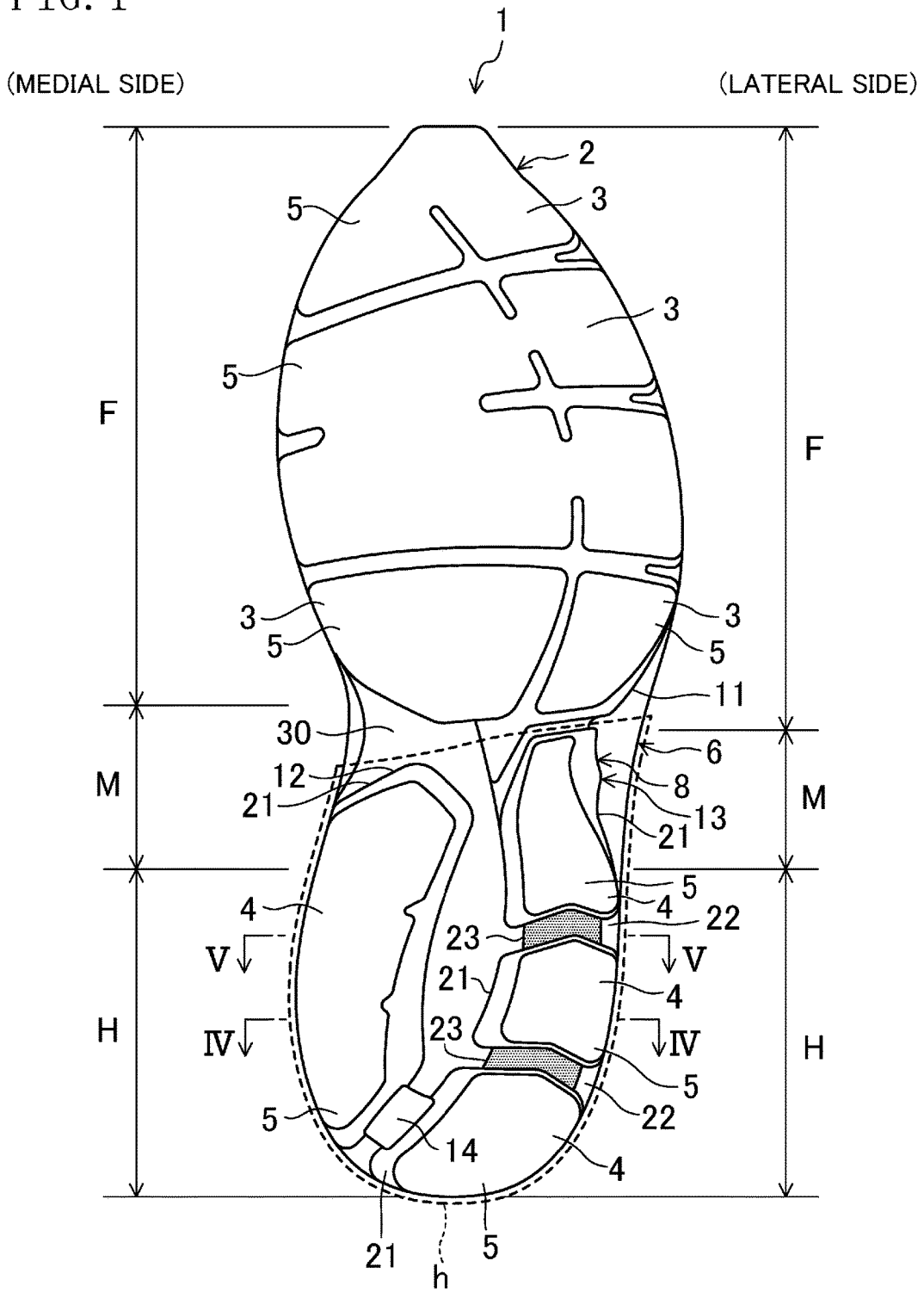
FIG. 1 is a bottom view of a sole structure according to a first embodiment of the present disclosure.
Figure 2:
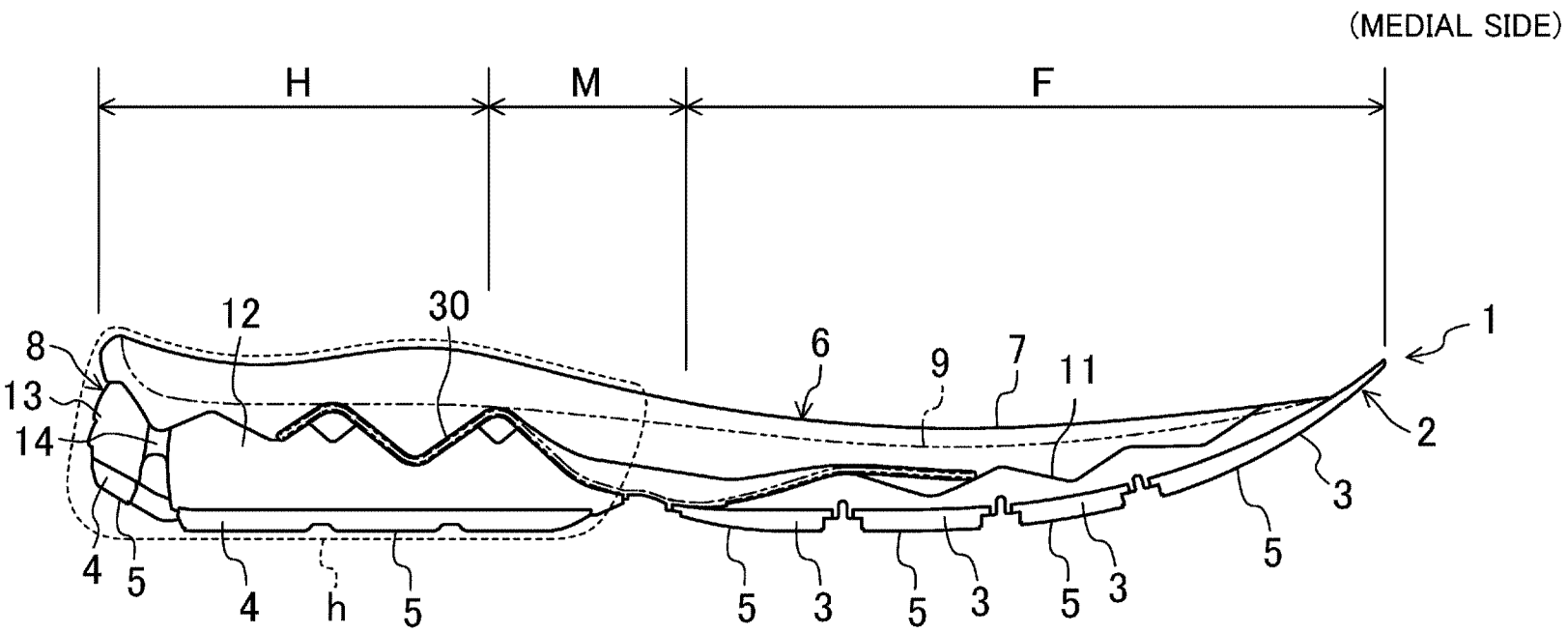
FIG. 2 is a side view of the sole structure, as viewed from a medial side.
Figure 3:
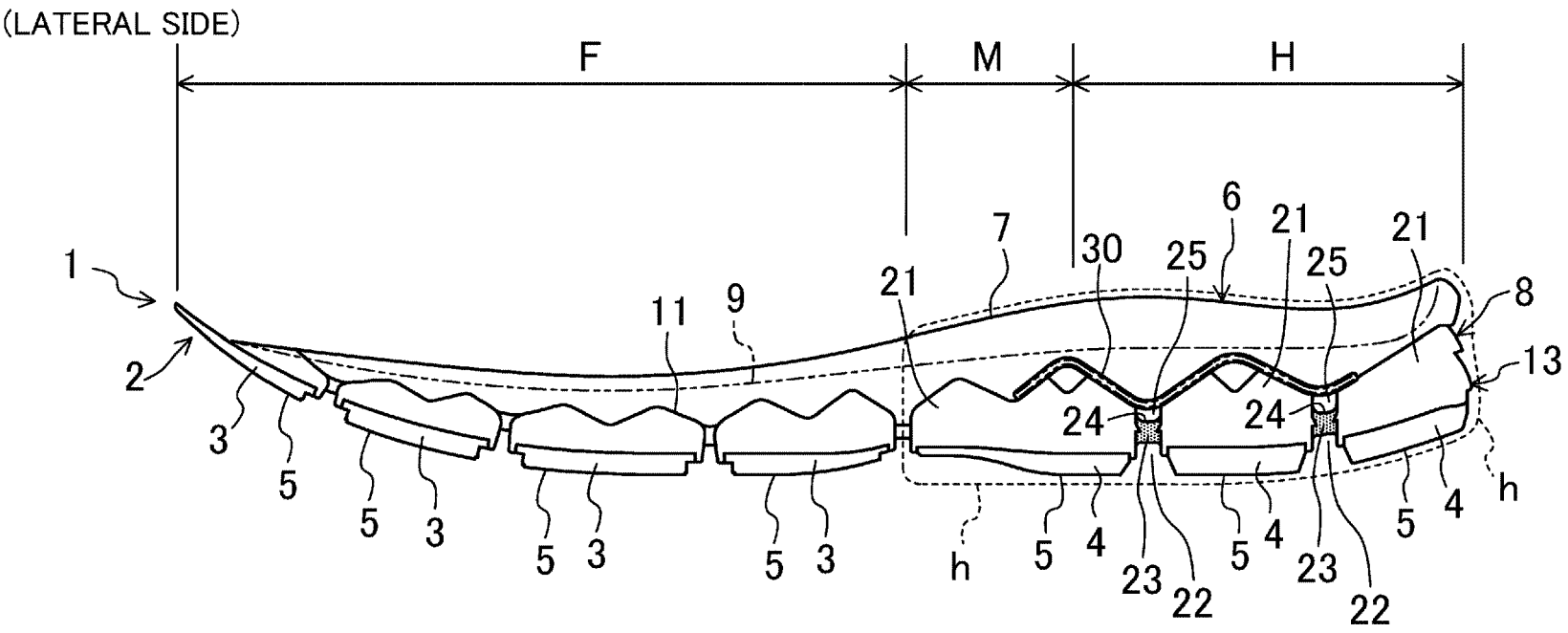
FIG. 3 is a side view of the sole structure, as viewed from a lateral side.

FIGS. 1-3 show a whole sole structure 1 for shoes according to a first embodiment of the present disclosure. A pair of shoes including this sole structure 1 and a shoe upper (not shown) provided on the sole structure 1 may be used, for example, as athletic shoes for running and various sports, sneakers for daily use, or rehabilitation shoes.

The drawings show the sole structure 1 for a left shoe only. A sole structure 1 for a right shoe is symmetrical to the sole structure 1 for the left shoe. In the following description including the embodiments and variations, only the sole structure 1 for the left shoe will be described and, the description of the sole structure 1 for the right shoe will be omitted. In the following description, the expressions "above," "upward," "on a/the top of," "below," "under," and "downward," represent the vertical positional relationship between respective components of the sole structure 1. The expressions "front," "fore," "forward, "back," "hind," "behind," "backward" represent the positional relationship in the longitudinal direction (i.e., the longitudinal direction) between respective components of the sole structure 1. The expressions "medial side" and "lateral side" represent the positional relationship in the foot width direction (i.e., the foot width direction) between respective components of the sole structure 1.

The sole structure 1 includes an outsole 2 corresponding to a region of a wearer's foot from a fore portion of a forefoot F to a hind portion of a hindfoot H (heel). The outsole 2 is made from a hard elastic material which is harder than the material for a midsole 6, which will be described later. Non-limiting suitable examples of the material for the outsole 2 include thermoplastic resins such as ethylene-vinyl acetate copolymer (EVA), thermosetting resins such as polyurethane (PU), and rubber materials such as butadiene rubber and chloroprene rubber.

The outsole 2 is comprised of a plurality of fore outsoles 3 and a plurality of hind outsoles 4. The fore outsoles 3 support the forefoot F. The hind outsoles 4 are separated from the fore outsoles 3 and support a region from a midfoot M to the hindfoot H. Each of the fore outsoles 3 and the hind outsoles 4 has, on its lower surface, a ground surface 5 configured to touch the ground.

The sole structure 1 further includes the midsole 6 which supports a region, of the wearer's plantar, from the forefoot F to the hindfoot H. The midsole 6 is made from a soft elastic material. Non-limiting suitable examples of the material for the midsole 6 include thermoplastic resins such as ethylene-vinyl acetate copolymer (EVA) and foams of the thermoplastic resins, thermosetting resins such as polyurethane (PU) and foams of the thermosetting resins, and rubber materials such as butadiene rubber and chloroprene rubber and foams of the rubber materials. A shoe upper (not shown) covering the wearer's foot is attached to a peripheral portion of the midsole 6.

The midsole 6 is divided in the vertical direction. Specifically, the midsole 6 includes a lower midsole 8 which is overlaid above the outsole 2 (i.e., the fore and hind outsoles 3 and 4) and an upper midsole 7 which is overlaid above the lower midsole 8 with a corrugated plate 30 interposed therebetween. The corrugated plate 30 will be described later.

Figure 4:
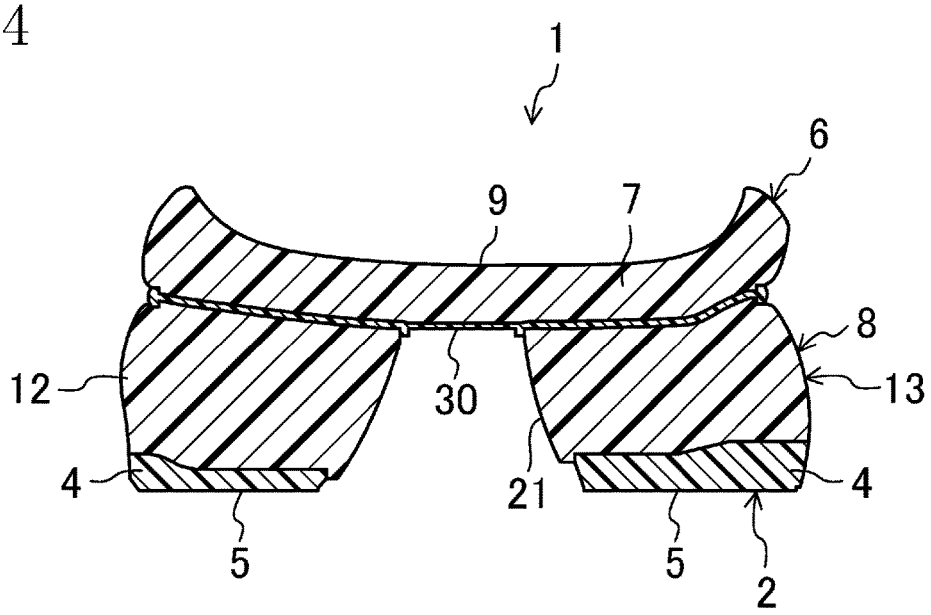
FIG. 4 is a cross-sectional view taken along the line IV-IV in FIG. 1.
Figure 5:
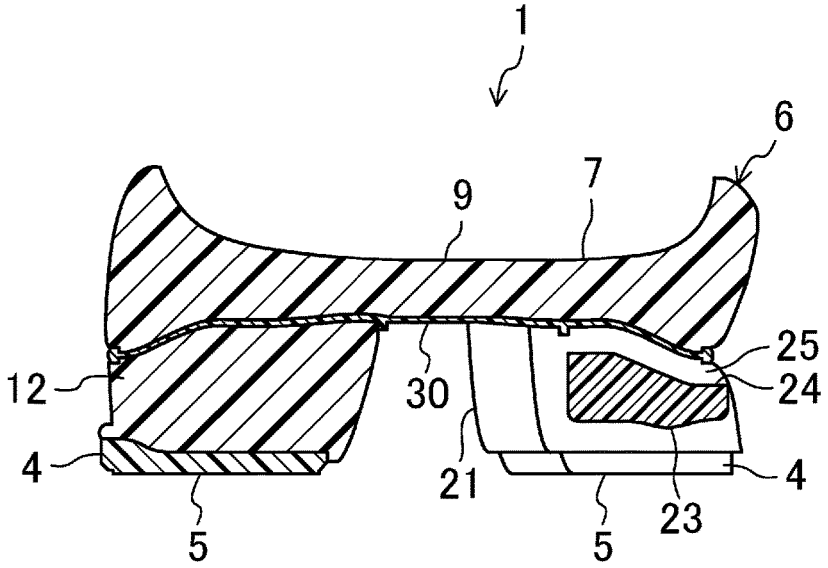
FIG. 5 is a cross-sectional view taken along the line V-V in FIG. 1.

The upper midsole 7 has a plantar support surface 9 which supports a region, of the wearer's planter, from a fore portion of the forefoot F to a hind portion of the hindfoot H. As shown in FIGS. 4 and 5, the plantar support surface 9 is curved downward toward the outsole 2, and shaped such that its peripheral portions corresponding to the medial side and the lateral side are located above its central portion in the foot width direction.

As shown in FIGS. 1-3, the lower midsole 8 includes a forefoot-side midsole portion 11. The forefoot-side midsole portion 11 is arranged at a position corresponding to the forefoot of the wearer's foot.

As shown in FIGS. 1 and 2, the lower midsole 8 includes a medial-side midsole portion 12 arranged at a position corresponding to a medial side portion of a heel region h which supports the heel of the wearer's foot. The medial-side midsole portion 12 extends in the longitudinal direction so as to correspond to a region, of the wearer's foot, from the navicular bone to a hind side of the heel bone, for example, and is shaped so as to have a greater thickness in the vertical direction than the forefoot-side midsole portion 11. As a result, the sole structure 1 has increased cushioning in the medial side portion of the heel region h. The heel region h covers a region, of the wearer's foot, from the midfoot M to the hindfoot H. However, the heel region h is not limited to this region.

As shown in FIGS. 1 and 3, the lower midsole 8 further includes a lateral-side midsole portion 13 provided at a position corresponding to a lateral side portion of the heel region h. The lateral-side midsole portion 13 faces, and is spaced apart from, the medial-side midsole portion 12, in the foot width direction. The lateral-side midsole portion 13 extends in the longitudinal direction so as to correspond to a region, of the wearer's foot, from the cuboid bone to a hind side of the heel bone, for example.

The lateral-side midsole portion 13 is integral with the forefoot-side midsole portion 11 such that a fore end portion of the lateral-side midsole portion 13 is continuous with a hind end portion of the forefoot-side midsole portion 11. The lateral-side midsole portion 13 is integral with the medial-side midsole portion 12 such that a hind end portion of the lateral-side midsole portion 13 is continuous with a hind end portion of the medial-side midsole portion 12 via a connecting portion 14 which is made of part of the lower midsole 8.

In the sole structure 1 according to this embodiment, the forefoot-side midsole portion 11 and the medial-side midsole portion 12 are not integral with each other. In other words, the forefoot-side midsole portion 11 and the medial-side midsole portion 12 are separate from each other. However, the sole structure 1 is not limited to this configuration, and the forefoot-side midsole portion 11 and the medial-side midsole portion 12 may be integral with each other such that a hind end portion of the forefoot-side midsole portion 11 is continuous with a fore end portion of the medial-side midsole portion 12. On the other hand, the forefoot-side midsole portion 11 and the lateral-side midsole portion 13 are integral with each other, as described above. However, the sole structure 1 is not limited to this configuration, and the forefoot-side midsole portion 11 and the lateral-side midsole portion 13 may be separate from each other.

The lateral-side midsole portion 13 includes a plurality of supports 21 (three supports 21 in the shown example) which support a lateral side portion of the heel of the wearer's foot. A gap 22 is provided between adjacent ones of the supports 21. Thus, the supports 21 are arranged adjacent to each other in the longitudinal direction, with the gaps 22 interposed therebetween.

Each support 21 is shaped so as to have a greater thickness in the vertical direction than forefoot-side midsole portion 11. As a result, the sole structure 1 has increased cushioning in a lateral side portion of the heel region h.

As shown in FIG. 1, the support 21 adjacent to the forefoot-side midsole portion 11 is shaped so as to have a hind side bent, at a substantial middle, forward and in the direction toward the inside of the support 21, as viewed from the bottom. The second support 21 from the fore has a similar hind side. The second and third supports 21 from the fore are shaped to have a fore side bent, at a substantial middle, forward and toward the outside of the support 21, as viewed from the bottom.

As shown in FIGS. 1 and 3, a coupling portion 23 is provided in each of the gaps 22 between the adjacent supports 21 and couples the adjacent supports 21 to each other. Each coupling portion 23 in the associated gap 22 is configured to reduce displacement or twist in the foot width direction occurring between the supports 21. In FIGS. 1 and 3, each coupling portion 23 is marked and accentuated with dot hatching.

Each coupling portion 23 has a flat plate shape, and is made of part of the lateral-side midsole portion 13 and integral with the supports 21. Specifically, each coupling portion 23 has a fore end portion continuous with a hind end portion of the support 21 located forward of the coupling portion 23, and a hind end portion continuous with a fore end portion of another support 21 located behind the coupling portion 23. Each coupling portion 23 substantially has an inverted V-shape, as viewed from the bottom. Further, as shown in FIG. 5, each coupling portion 23 has a shape of which a length in the foot width direction is greater than a thickness in the vertical direction.

As shown in FIG. 3, each coupling portion 23 is arranged at a substantially middle in the vertical direction in the associated gap 22, as viewed from the lateral side. A groove 24 which is recessed downward and extends in the foot width direction is formed in an upper portion of each coupling portion 23. As shown also in FIG. 5, a clearance 25 extending in the foot width direction is provided between each groove 24 and the corrugated plate 30 which will be described later. Specifically, each clearance 25 is located in correspondence to the associated gap 22 between the supports 21 adjacent in the longitudinal direction, and surrounded and defined by the associated recess 24 forming the bottom of the clearance 25, the fore and hind ends of the adjacent supports 21, and a lower portion of the corrugated plate 30 (corresponding to an upper portion of the associated gap 22). The clearance 25 provided above the coupling portion 23 substantially prevents the supports 21 adjacent in the longitudinal direction from interfering with each other when the sole structure 1 is bent in the longitudinal direction.

As shown in FIGS. 1-5, the sole structure 1 further includes the corrugated plate 30 which is overlaid at a middle of the thickness direction of the midsole 6 and interposed between the upper and lower midsoles 7 and 8. The corrugated plate 30 is comprised of a thin layer which is harder than the midsole 6, and is beneficially made from a hard elastic material. Specific examples of such a hard elastic material include thermoplastic resins such as thermoplastic polyurethane (TPU), polyamide elastomer (PAE), and ABS, and thermosetting resins such as epoxy resins and unsaturated polyester resins. The corrugated plate 30 may be made from a fiber-reinforced plastic (FRP) containing carbon fibers, aramid fibers, or glass fibers as reinforcement fibers, and a thermosetting resin or a thermoplastic resin as a matrix resin.

The corrugated plate 30 extends in the longitudinal direction in a region from the midfoot M to the hindfoot H, and is curved to be corrugated in the vertical direction, in a side view. As shown in FIGS. 4 and 5, the corrugated plate 30 has a width (a dimension in the foot width direction) substantially equal to the width (a dimension in the foot width direction) of the upper midsole 7. The lower surface and upper surface of the corrugated plate 30 are bonded respectively to the upper surface of the lower midsole 8 and the lower surface of the upper midsole 7 with an adhesive, for example.

The provision of the corrugated plate 30 substantially prevents the midsole 6 from being deformed locally and significantly even if an impact in the vertical direction is applied mainly to the hindfoot H. Consequently, when the wearer is walking or running, the wearer's ankle is substantially prevented from excessively leaning inward or outward, thereby substantially ensuring increased stability.

Advantages of Embodiment

In general, when a shoe touches the ground while the wearer is walking or running, a so-called load path, which represents the shift of the wearer's body weight, occurs in the wearer's foot. The load path starts from a lateral side portion of a heel region h in a hindfoot H, passes through a central region of the hindfoot H in the foot width direction, a central portion of a midfoot M, and a medial side portion of a forefoot F, and reaches the tiptoes. In this load path, an initial impact which occurs when the wearer's shoe touches the ground is mainly applied to the heel region h.

According to the sole structure 1 of this embodiment, the lateral-side midsole portion 13 includes the plurality of supports 21 that support a lateral side portion of the heel of the wearer's foot and that are arranged adjacent to each other in the longitudinal direction with the gaps 22 interposed therebetween. When the sole structure 1 touches the ground, each gap 22 allows the adjacent supports 21 to rock toward and away from each other (i.e. in the longitudinal direction) in the gap 22. Consequently, when the wearer's shoe touches the ground along the load path described above, the lateral-side midsole portion 13 having the supports 21 is easily bent in the longitudinal direction. This bending of the lateral-side midsole portion 13 causes the hindmost support 21 to touch the ground first, and then, causes the other supports 21 located forward of the hindmost support 21 to touch the ground sequentially along the load path. As can be seen, the lateral-side midsole portion 13 is pliantly bent in the longitudinal direction along the load path, thereby reducing the angular velocity (so-called plantar flexion angular velocity) of the wearer's foot joints to a moderate level, and keeping the heel region h stably in contact with the ground for a sufficient period of time. As a result, the sole structure 1 is capable of sufficiently cushioning the initial impact applied to the wearer's foot.

Each coupling portion 23 provided in the associated gap 22 and coupling the adjacent supports 21 to each other is configured to reduce displacement or twist in the foot width direction occurring between the supports 21. The coupling portions 23 maintain the supports 21 stabilized such that the supports 21 are substantially prevented from excessively leaning toward the medial side or the lateral side even if the initial impact described above is applied to the supports 21. That is to say, in the sole structure 1, while the coupling portions 23 substantially prevent the supports 21, which are provided to the lateral-side midsole portion 13 arranged in a lateral side portion of the heel region h, from swinging in the foot width direction, the wearer is allowed to step the ground stably.

Thus, the sole structure 1 of the present disclosure cushions the initial impact applied when the wearer's shoe touches the ground, and allows the wearer to feel his/her foot softly touch the ground. In particular, while the lateral side portion of the heel region h is substantially prevented from swinging in the foot width direction, the wearer is allowed to step the ground stably. As a result, the sole structure 1 is capable of guiding the wearer's body weight along the optimal load path on the wearer's foot when the wearer is walking or running.

Further, each coupling portion 23 has a shape of which a length in the foot width direction is greater than a thickness in the vertical direction. Specifically, making the thickness in the vertical direction of each coupling portion 23 relatively thin may reduce the flexural rigidity in the longitudinal direction of the coupling portion 23, while making the length in the foot width direction of each coupling portion 23 relatively long may increase the flexural rigidity in the foot width direction of the coupling portion 23. Consequently, the lateral-side midsole portion 13 is easily bent in the longitudinal direction at the coupling portions 23, and the supports 21 may be substantially prevented from excessively leaning toward the medial side or the lateral side even if the initial impact described above is applied to the supports 21.

Further, each coupling portion 23 is arranged at a substantially middle in the vertical direction in the associated gap 22, in a side view. This facilitates the supports 21 to rock relative to each other in the longitudinal direction with respect to the coupling portion 23. The clearance 25 provided above the coupling portion 23 prevents the supports 21 from interfering with each other. Therefore, when the lateral-side midsole portion 13 is bent upward, the supports 21 are not allowed to interfering with each other in the clearance 25 provided above the coupling portion 23. Thus, the lateral-side midsole portion 13 of the sole structure 1 may have further increased flexibility.

Further, the groove 24 formed in an upper portion of each coupling portion 23 facilitates the supports 21 to rock relative to each other in the longitudinal direction with respect to the groove 24 of each coupling portion 23. Thus, the lateral-side midsole portion 13 may have further increased flexibility.

Variation of First Embodiment

Figure 6:
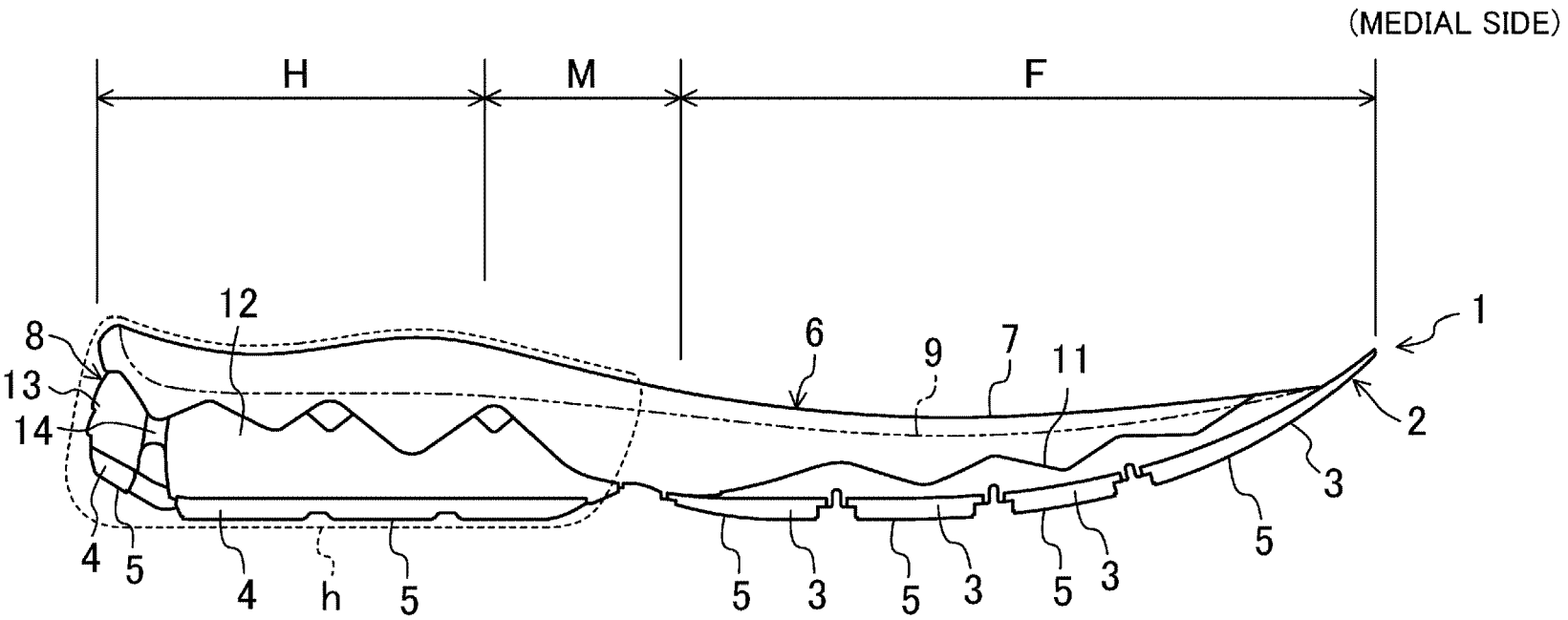
FIG. 6 corresponds to FIG. 2, and shows a variation of the sole structure according to the first embodiment.
Figure 7:
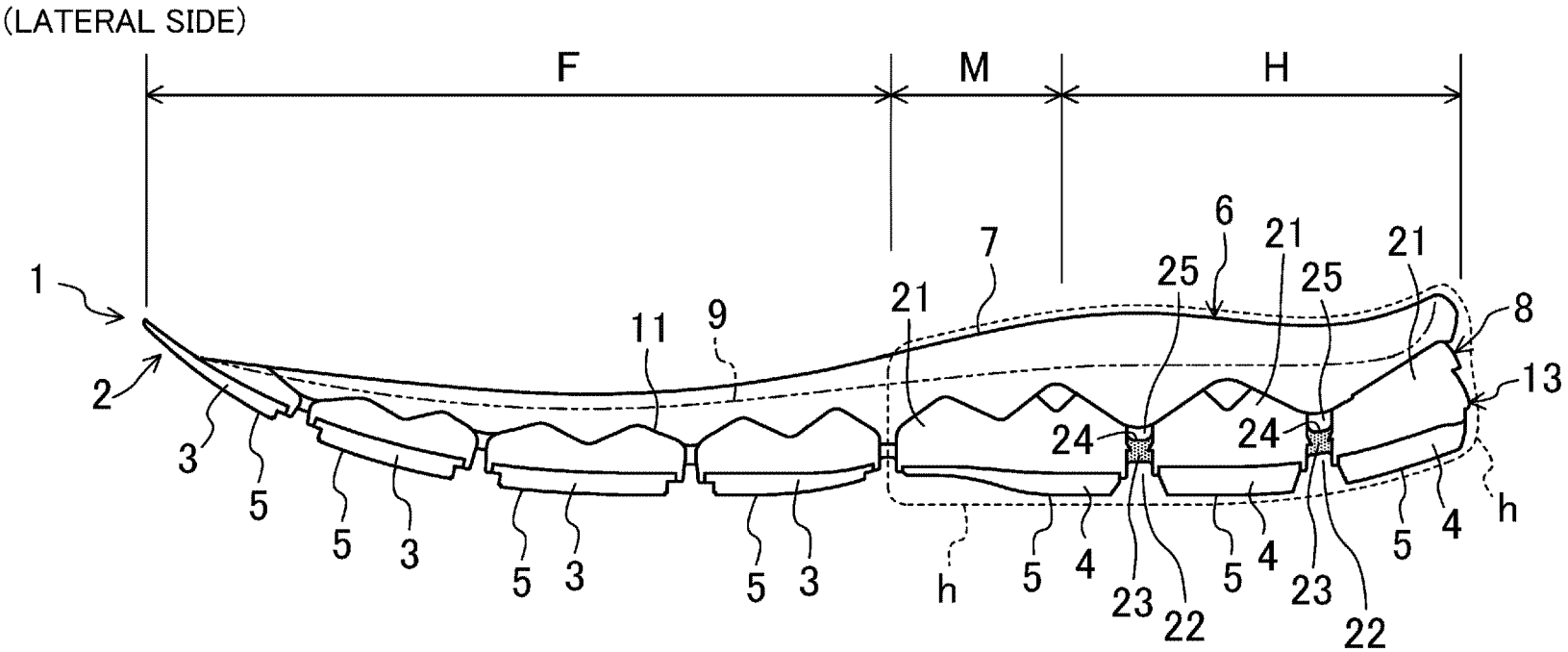
FIG. 7 corresponds to FIG. 3, and shows the variation of the sole structure according to the first embodiment.

FIGS. 6 and 7 show a variation of the first embodiment. Note that the sole structure 1 of this variation is the same as the sole structure 1 of the first embodiment, except differences described below. Therefore, components that are the same as those shown in FIGS. 1-5 are denoted by the corresponding reference characters, and a detailed description thereof is omitted herein.

As shown in FIGS. 6 and 7, the sole structure 1 of this variation is not provided with the corrugated plate 30. Specifically, in the sole structure 1 of this variation, an upper midsole 7 is overlaid above a lower midsole 8 without the corrugated plate 30 interposed therebetween. As shown in FIG. 7, a clearance 25 is located in correspondence to an associated gap 22 between supports 21 adjacent in the longitudinal direction, and surrounded and defined by a recess 24 forming the bottom of the clearance 25, the fore and hind ends of the adjacent supports 21, and a lower portion of the upper midsole 7 (corresponding to an upper portion of the associated gap 22). Thanks to the supports 21 and coupling portions 23 of the lateral-side midsole portion 13, the sole structure 1 of this variation may also provide the same advantages as those provided by the first embodiment.

Second Embodiment

Figure 8:
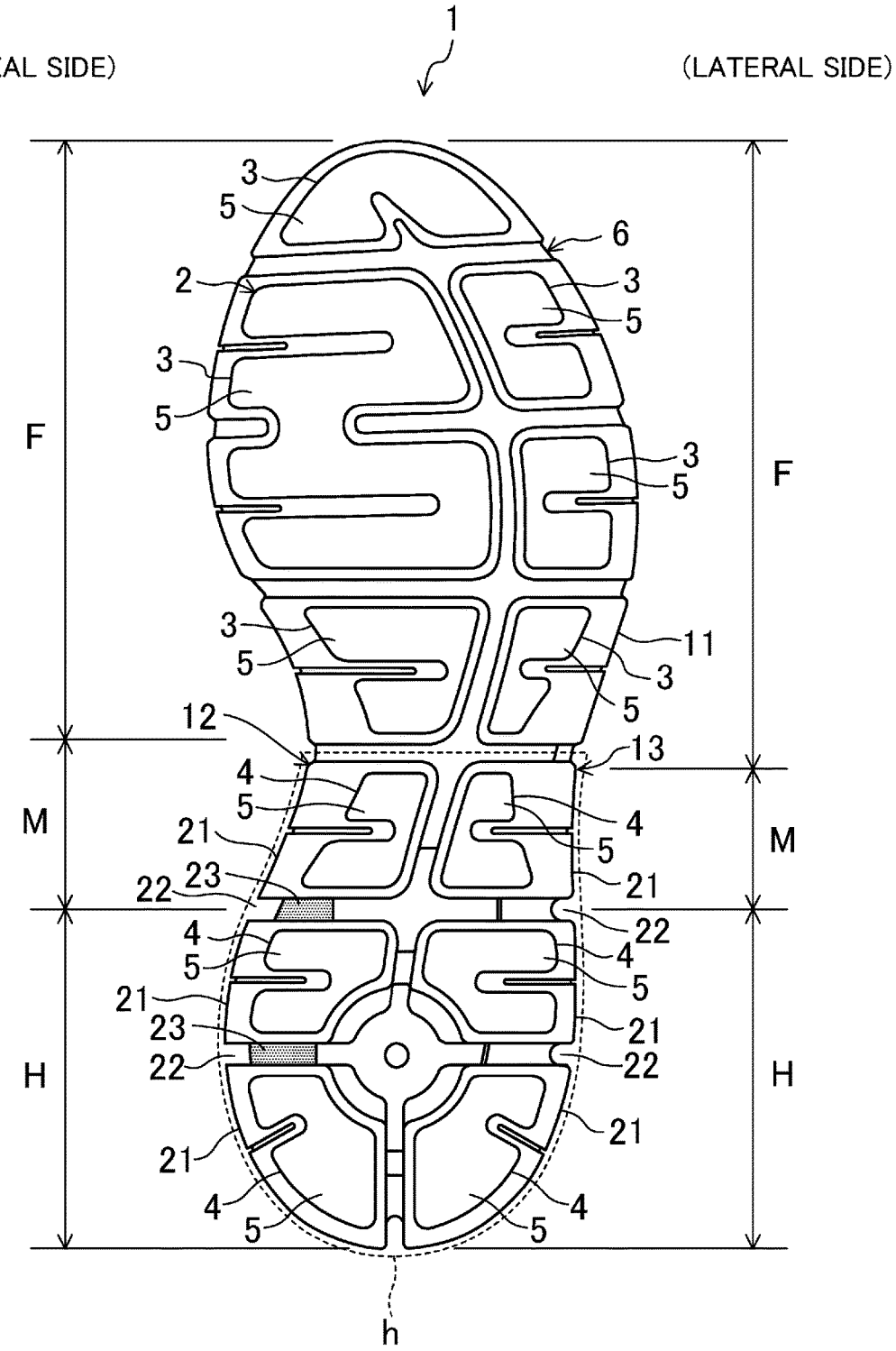
FIG. 8 corresponds to FIG. 1, and shows a sole structure according to a second embodiment of the present disclosure.
Figure 9:
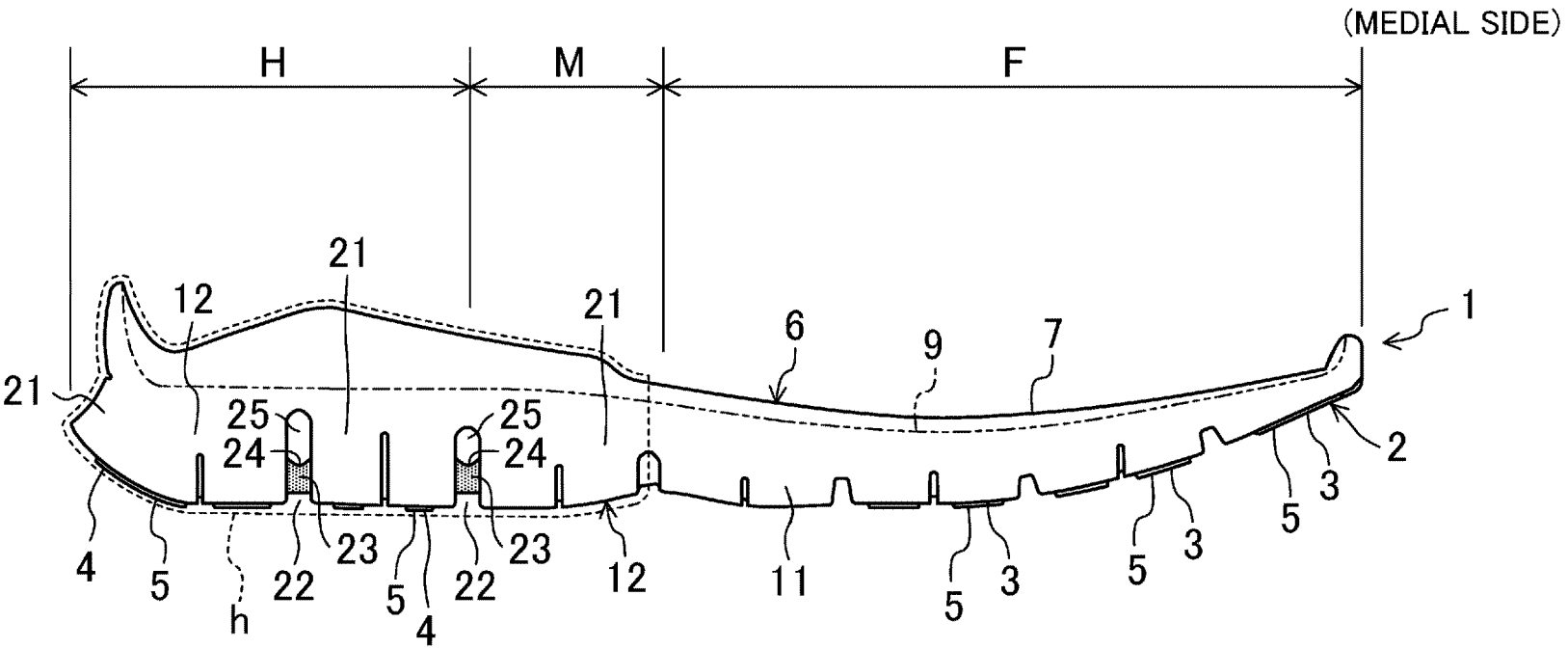
FIG. 9 corresponds to FIG. 2, and shows the sole structure according to the second embodiment.
Figure 10:
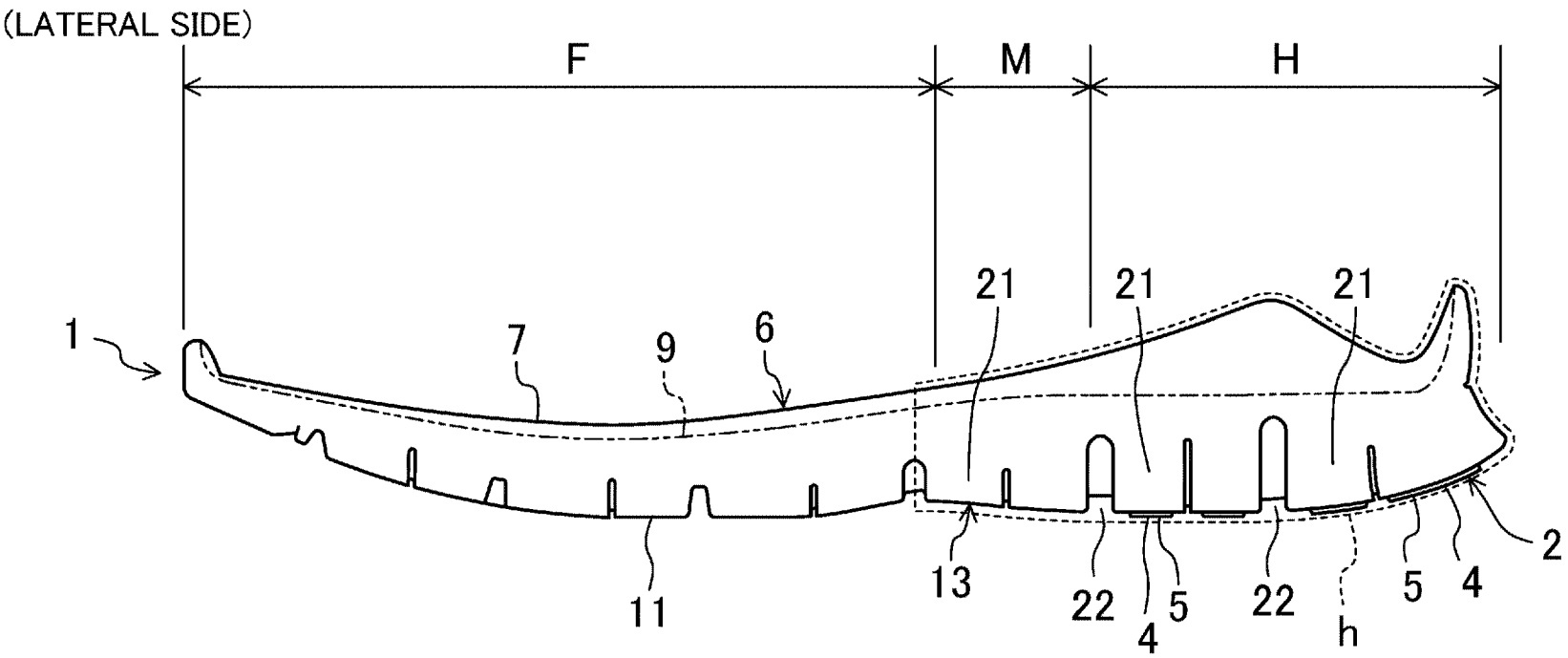
FIG. 10 corresponds to FIG. 3, and shows the sole structure according to the second embodiment.

FIGS. 8-10 show a sole structure 1 according to a second embodiment of the present disclosure. The second embodiment differs from the first embodiment in particular in the arrangement of the supports 21 and coupling portions 23. The second embodiment differs from the first embodiment also in the configuration of the midsole 6, and is not provided with the corrugated plate 30. Note that the sole structure 1 of this embodiment is the same as the sole structure 1 of the first embodiment, except these differences. Therefore, components that are the same as those shown in FIGS. 1-5 are denoted by the corresponding reference characters, and a detailed description thereof is omitted herein.

As shown in FIGS. 8-10, unlike the first embodiment, the midsole 6 of the second embodiment is not divided into upper and lower portions. In other words, the midsole 6 of the second embodiment corresponds to a midsole into which the lower midsole 8 and the upper midsole 7 of the first embodiment are integrated.

The midsole 6 includes a forefoot-side midsole portion 11, a medial-side midsole portion 12, and a lateral-side midsole portion 13. The lateral-side midsole portion 13 includes a plurality of supports 21 (three supports 21 in the shown example) and no coupling portions 23. That is to say, the lateral-side midsole portion 13 of this embodiment differs from that of the first embodiment in that the lateral-side midsole portion 13 of this embodiment does not include coupling the portions 23 in the gaps 22 between the supports 21. On the other hand, the medial-side midsole portion 12 of this embodiment includes a plurality of supports 21 (three supports 21 in the shown example) and a plurality of coupling portions 23. In FIGS. 8 and 9, each coupling portion 23 is marked and accentuated with dot hatching, just like the first embodiment.

As shown in FIG. 8, each support 21 is shaped so as to have a linear fore side extending in the foot width direction, as viewed from the bottom. The support 21 adjacent to the forefoot-side midsole portion 11 and the second supports 21 from the fore are shaped so as to have a linear hind side extending in the foot width direction, as viewed from the bottom. Each coupling portion 23 has a substantially rectangular shape, as viewed from the bottom. Since the coupling portions 23 of this embodiment are the same as those of the first embodiment, except this difference, a detailed description thereof is omitted herein.

As shown in FIG. 9, a clearance 25 is located in correspondence to the associated gap 22 between the supports 21 adjacent in the longitudinal direction, and surrounded and defined by a recess 24 forming the bottom of the clearance 25, the fore and hind ends of the adjacent supports 21, and an upper portion of the associated gap 22. Since the recesses 24 and the clearances 25 of this embodiment are the same as those of the first embodiment, except the difference, a detailed description thereof is omitted herein.

As can be seen, in the sole structure 1 of this embodiment, the medial-side midsole portion 12 includes the supports 21 and the coupling portions 23, while the lateral-side midsole portion 13 includes the supports 21 and no coupling portions 23. Thus, both the medial-side midsole portion 12 and the lateral-side midsole portion 13 cushion the initial impact applied when the wearer's shoe touches the ground, and allow the wearer's foot to feel softly touch with the ground. Further, while the medial side portion of the heel region h is substantially prevented from swinging in the foot width direction, the wearer is allowed to step the ground stably.

Other Embodiments

Figure 11:
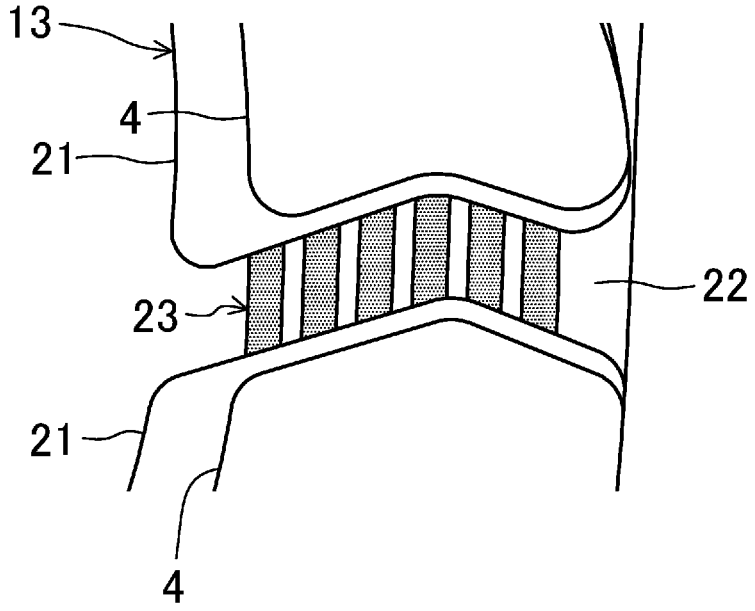
FIG. 11 shows, on an enlarged scale, a structure in a vicinity of a coupling portion of a sole structure according to another embodiment.

The sole structure 1 of each of the embodiments described above includes the coupling portions 23 having a flat plate shape. However, this is merely a non-limiting example. For example, as shown in FIG. 11, the sole structure 1 may include band-shaped coupling portions 23 arranged side by side. This configuration may increase the flexural rigidity in the foot width direction of the coupling portions 23 and substantially prevent the supports 21 from excessively leaning toward the medial side or the lateral side even if the initial impact described is applied to the supports 21.

The sole structure 1 of each of the embodiments described above includes the coupling portions 23 each made of part of the lateral-side midsole portion 13 or the medial-side midsole portion 12. However, this is merely a non-limiting example. In other words, the coupling portions 23 may be made from a material different from that forming the lateral-side midsole portion 13.

Further, each of the medial-side and lateral-side midsole portions 12 and 13 may include the supports 21 and the coupling portions 23. With this configuration, both the medial-side and lateral-side midsole portions 12 and 13 cushion the initial impact applied when the wearer's shoe touches the ground, and allow the wearer to feel his/her foot softly touch the ground. Further, with this configuration, while both the medial and lateral side portions of the heel region h are substantially prevented from swinging in the foot width direction, the wearer is allowed to step the ground stably.

In the sole structure 1 of each of the embodiments described above, each coupling portion 23 is arranged at the substantially middle in the vertical direction in the associated gap 22, as viewed from the lateral side or the medial side. However, this is merely a non-limiting example. For example, a configuration in which each coupling portion 23 is arranged above the substantial middle in the vertical direction may increase the flexibility in the longitudinal direction of the heel region h of the midsole 6. In contrast, a configuration in which each coupling portion 23 is arranged below the substantial middle in the vertical direction may increase the flexural rigidity of the heel region h of the midsole 6. As can be seen, both the flexibility and the flexural rigidity of the heel region h of the midsole 6 may be adjusted appropriately by changing the position of each coupling portion 23.

Note that the present disclosure is not limited to the embodiments described above, and various changes and modifications may be made without departing from the scope of the present disclosure.

The present disclosure is industrially applicable to, for example, a sole structure for athletic shoes for walking, running, and various sports, sneakers for daily use, or rehabilitation shoes and to shoes including the sole structure.

What is claimed is:

1. A sole structure for shoes, the sole structure comprising:

an outsole having a ground surface on a lower surface of the outsole; and a midsole made from an elastic material and overlaid above the outsole, wherein the midsole includes:

a medial-side midsole portion which extends in a longitudinal direction in a medial side portion of a heel region supporting a heel of a wearer's foot, and a lateral-side midsole portion which extends in the longitudinal direction in a lateral side portion of the heel region, and which faces, and is spaced apart from, the medial-side midsole portion in a foot width direction, at least one of the medial-side midsole portion or the lateral-side midsole portion includes:

a plurality of supports which are arranged adjacent to each other in the longitudinal direction with a gap interposed between adjacent ones of the plurality of supports, and which support the heel of the wearer's foot, and a coupling portion which is provided in the gap, and couples the adjacent ones of the plurality of supports to each other to reduce displacement or twist in the foot width direction occurring between the adjacent ones of the plurality of supports, the plurality of supports and the coupling portion are made of the elastic material that is solid, and the coupling portion has a flat plate shape of which a length in the foot width direction is greater than a thickness in a vertical direction, and is integral with the supports.

2. The sole structure of claim 1, wherein the coupling portion is arranged at a substantially middle in a vertical direction in the gap, in a side view, and a clearance is provided above the coupling portion to keep the plurality of supports from interfering with each other.

3. A shoe comprising the sole structure of claim 2.

4. The sole structure of claim 2, wherein a groove which is recessed downward and extends in the foot width direction is formed in an upper portion of the coupling portion.

5. A shoe comprising the sole structure of claim 4.

6. The sole structure of claim 1, wherein the lateral-side midsole portion includes the plurality of supports and the coupling portion.

7. A shoe comprising the sole structure of claim 6.

8. The sole structure of claim 1, wherein the medial-side midsole portion includes the plurality of supports and the coupling portion, and the lateral-side midsole portion includes the plurality of supports and no coupling portions.

9. A shoe comprising the sole structure of claim 8.

10. The sole structure of claim 1, wherein the lateral-side midsole portion and the medial-side midsole portion each include the plurality of supports and the coupling portion.

11. A shoe comprising the sole structure of claim 10.

12. A shoe comprising the sole structure of claim 1.

* * * * *